US010955183B2

(12) United States Patent
Jung

(10) Patent No.: US 10,955,183 B2
(45) Date of Patent: Mar. 23, 2021

(54) REFRIGERATOR

(71) Applicant: Samsung Electronics Co., Ltd, Gyeonggi-do (KR)

(72) Inventor: Moon Gyo Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 319 days.

(21) Appl. No.: 15/855,926

(22) Filed: Dec. 27, 2017

(65) Prior Publication Data

US 2018/0187945 A1 Jul. 5, 2018

(30) Foreign Application Priority Data

Jan. 3, 2017 (KR) ..... 10-2017-0000949

(51) Int. Cl.

| | |
|---|---|
| ***F25D 17/08*** | (2006.01) |
| ***F25D 17/06*** | (2006.01) |
| ***F25D 23/06*** | (2006.01) |

(52) U.S. Cl.

CPC ..... *F25D 17/062* (2013.01); *F25D 23/066* (2013.01); *F25D 2317/06* (2013.01); *F25D 2400/18* (2013.01)

(58) Field of Classification Search

CPC ..... F25D 17/062; F25D 17/08; F25D 23/061; F25D 23/065; F25D 23/066

USPC ..... 312/401, 406, 407, 407.1

See application file for complete search history.

(56) References Cited

U.S. PATENT DOCUMENTS

| | | | | |
|---|---|---|---|---|
| 1,362,101 | A * | 12/1920 | Hillman | F25D 23/065 312/407.1 |
| 1,429,649 | A | 9/1922 | Simons | |
| 1,583,819 | A * | 5/1926 | Whittier | F25D 23/065 312/407.1 |
| 3,177,271 | A * | 4/1965 | Slayman | F25D 23/064 264/46.5 |
| 3,407,016 | A | 10/1968 | Kronenberger | |
| 2016/0084568 | A1* | 3/2016 | Jung | F25D 23/061 312/404 |

FOREIGN PATENT DOCUMENTS

| | | | |
|---|---|---|---|
| CN | 1517653 | A | 8/2004 |
| CN | 104254749 | A | 12/2014 |
| CN | 105910370 | A | 8/2016 |
| JP | H07174455 | A | 7/1995 |
| JP | 3657184 | B2 | 6/2005 |
| JP | 2009015763 | A | 1/2009 |

(Continued)

OTHER PUBLICATIONS

Communication under Rule 71(3) EPC dated Jan. 23, 2019 in connection with European Patent Application No. 18 150 210.5, 38 pages.

(Continued)

*Primary Examiner* — James O Hansen

(57) ABSTRACT

Disclosed herein is a refrigerator having an improved configuration of an inner wall forming a storage compartment and capable of improving an appearance of the storage compartment. The refrigerator includes a main body having a storage compartment, an inner case forming an inner space of the main body, and a cover plate installed inside the inner case to form an exterior of the storage compartment and formed of a ceramic material.

12 Claims, 12 Drawing Sheets

(56) References Cited

FOREIGN PATENT DOCUMENTS

| | | | |
|---|---|---|---|
| JP | 3184793 | U | 7/2013 |
| KR | 20150055691 | A | 5/2015 |
| KR | 101560693 | B1 | 10/2015 |

OTHER PUBLICATIONS

The First Office Action in connection with Chinese Application No. 201810004684.0 dated Oct. 28, 2019, 15 pages.
European Search Report dated Jun. 1, 2018 in connection with European Patent Application No. 18 15 0210.

* cited by examiner

REFRIGERATOR

CROSS-REFERENCE TO RELATED APPLICATION

This application is related to and claims priority to Korean Patent Application No. 10-2017-0000949 filed on Jan. 3, 2017, the disclosure of which is incorporated herein by reference.

TECHNICAL FIELD

Embodiments of the present disclosure relate to a refrigerator, and more particularly, to a refrigerator having a storage compartment whose exterior has an improved structure.

BACKGROUND

Generally, a refrigerator is a home appliance capable of supplying cold air generated in an evaporator to a storage compartment including a freezer compartment and a refrigerator compartment and keep and store various types of food fresh for a long period.

Food that should be kept at freezing temperature or below, such as meat, fish, and frozen dessert, is stored in the freezer compartment of the storage compartment, and food that should be kept above freezing temperature, such as vegetables, fruits, and beverages are stored in the refrigerator compartment.

Such a storage compartment of a refrigerator has an open front surface, and the open front surface is sealed by a door at ordinary times to maintain temperature of the storage compartment.

There have been recent attempts to arouse a consumer's desire to purchase a refrigerator by forming a pattern on an exterior of the refrigerator to improve an appearance of the refrigerator or forming the exterior of the refrigerator with a metal material such as stainless steel. Accordingly, the need for further improving an appearance of an interior of a storage compartment that a user faces when the user opens a door of a refrigerator in addition to the exterior of the refrigerator has come to the fore.

SUMMARY

To address the above-discussed deficiencies, it is a primary object to provide a refrigerator with an improved configuration of an inner wall forming a storage compartment, thereby improving an appearance of the storage compartment.

It is another aspect of the present disclosure to provide a refrigerator in which a possibility of damage due to an impact that may be generated in an actual use environment and during transport is low.

Additional aspects of the disclosure will be set forth in part in the description which follows and, in part, will be obvious from the description, or may be learned by practice of the disclosure.

In accordance with one aspect of the present disclosure, a refrigerator includes a main body having a storage compartment, an inner case forming an inner space of the main body, and a cover plate installed inside the inner case to form an exterior of the storage compartment and formed of a ceramic material.

The refrigerator may further include a cover panel configured to guide cold air to be supplied to the storage compartment, and the cover plate may be coupled to the cover panel.

The refrigerator may further include a fixing member fixed to one surface of the cover plate, and a fastening member configured to connect between the cover panel and the fixing member while the fixing member is fixed to the cover plate to allow coupling between the cover panel and the cover plate.

The fixing member may be fixed to the cover plate by an adhesive.

The cover panel may include an accommodation groove configured to accommodate the fixing member.

The cover panel and the cover plate may be coupled by an adhesive applied to have a predetermined pattern.

The cover panel and the cover plate may be coupled by a double-sided tape attached to have a predetermined pattern.

The cover plate may include an outlet configured to discharge cold air to the storage compartment and may further include a protector disposed at the outlet to protect an edge of the outlet.

The protector may include a front side protective member formed to cover a front side edge of the outlet while being coupled to the outlet.

The protector may include a protective member passing through the outlet while the cover plate and the cover panel are coupled and extending forward from the cover panel to protrude further forward than the edge of the outlet.

In accordance with another aspect of the present disclosure, a refrigerator includes a main body having a storage compartment therein, a cover panel having a cold air duct, which is configured to guide cold air to the storage compartment, formed at one side surface, and a cover plate coupled to the other side surface of the cover panel, forming an exterior of the storage compartment, and formed of a ceramic material.

The cover panel may include a rear cover panel forming a rear wall of the storage compartment and an upper cover panel forming an upper wall of the storage compartment, and the cover plate may include a rear cover plate coupled to the rear cover panel and an upper cover plate coupled to the upper cover panel.

The rear cover panel and the rear cover plate may include an outlet configured to discharge the cold air to the storage compartment and may further include a front side protective member installed at the outlet to cover a front side edge of the outlet.

The rear cover panel may include a rear side protective member configured to cover a rear side edge of the outlet.

The rear cover panel and the rear cover plate may include an outlet configured to discharge the cold air to the storage compartment, and the rear cover panel may include a protective member configured to cover the rear side edge of the outlet and extending to protrude further than the front side edge of the outlet.

In accordance with still another aspect of the present disclosure, a refrigerator includes an inner case forming an inner space, a cover panel configured to cover at least one surface of the inner case, and a cover plate configured to cover one side surface of the cover panel and including an outer layer formed of a ceramic material.

The refrigerator may further include at least one fixing member disposed at one side surface of the cover plate opposite the cover panel to allow coupling between the cover panel and the cover plate.

The cover panel may include an accommodation groove, which is configured to accommodate the fixing member, disposed at one side surface.

A hot melt type adhesive may be applied between the cover panel and the cover plate, and the cover panel and the cover plate may be adhered to each other.

A foam type double-sided tape may be disposed between the cover panel and the cover plate, and the cover panel and the cover plate may be adhered to each other.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
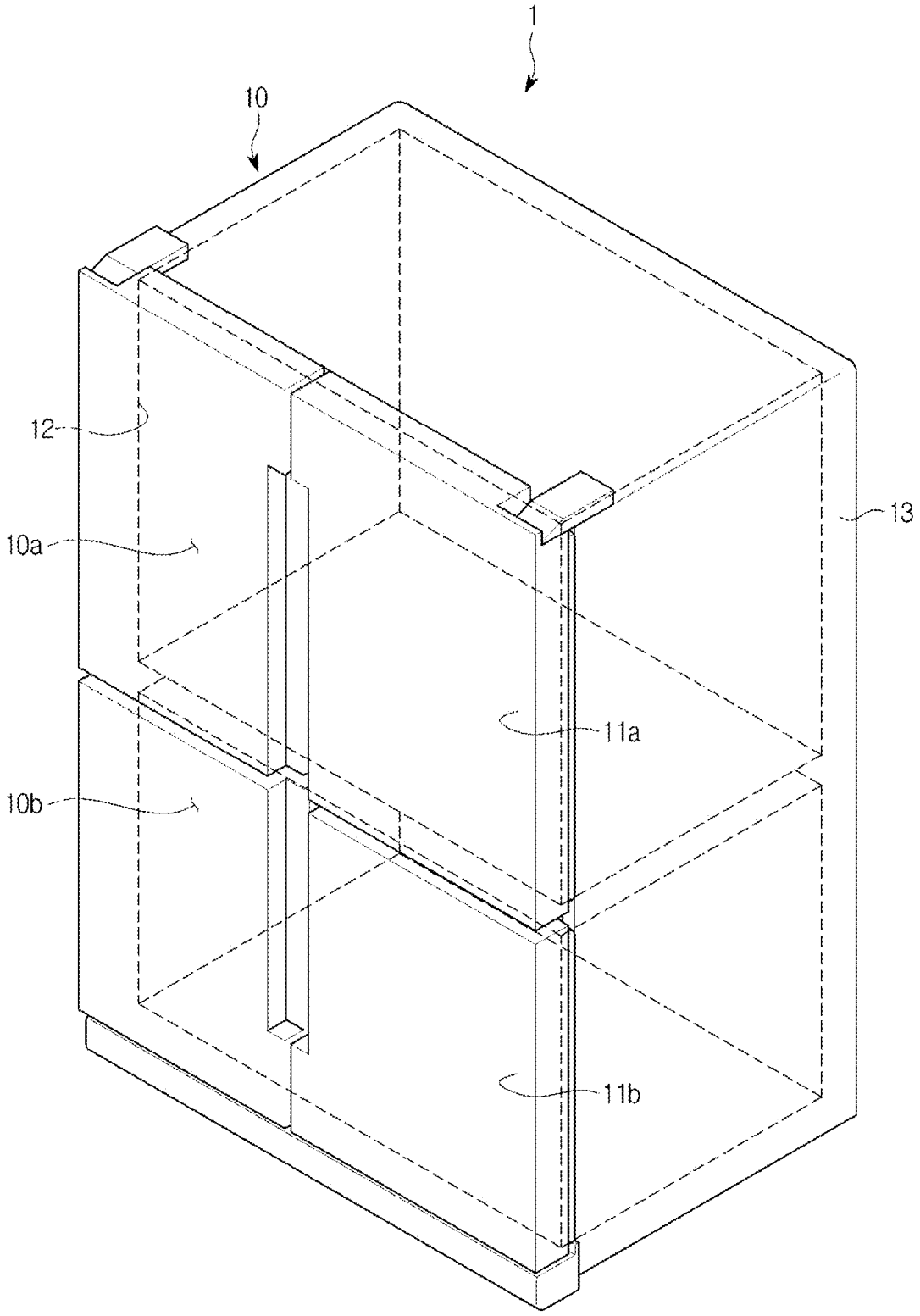
FIG. 1 is a perspective view illustrating a refrigerator according to an embodiment of the present disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described herein and configurations illustrated in the drawings are merely exemplary embodiments of the present disclosure, and various modifications which may replace the embodiments and the drawings herein may be present at the time at which this application is filed.

Like reference numerals or symbols presented in the drawings of the application indicate parts or elements that perform substantially the same functions.

Terms used herein are for describing the embodiments and are not intended to limit and/or restrict the disclosure. A singular expression includes a plural expression unless context clearly indicates otherwise. In the application, terms such as "include" or "have" should be understood as designating that features, number, steps, operations, elements, parts, or combinations thereof exist and not as precluding the existence or possibility of adding one or more other features, numbers, steps, operations, elements, parts, or combinations thereof in advance.

Terms including ordinals such as "first" and "second" used herein may be used to describe various elements, but the elements are not limited by the terms. The terms are only used for the purpose of distinguishing one element from another element. For example, a first element may be referred to as a second element, and likewise, a second element may also be referred to as a first element without departing from the scope of the present disclosure. The term "and/or" includes a combination of a plurality of described items or any one item among the plurality of described items.

Hereinafter, exemplary embodiments according to the present disclosure will be described in detail with reference to the accompanying drawings.

The term "front" used below refers to a direction toward the front of a refrigerator 1 illustrated in FIG. 1, and the term "rear" refers to a direction toward the rear of the refrigerator 1.

Figure 2:
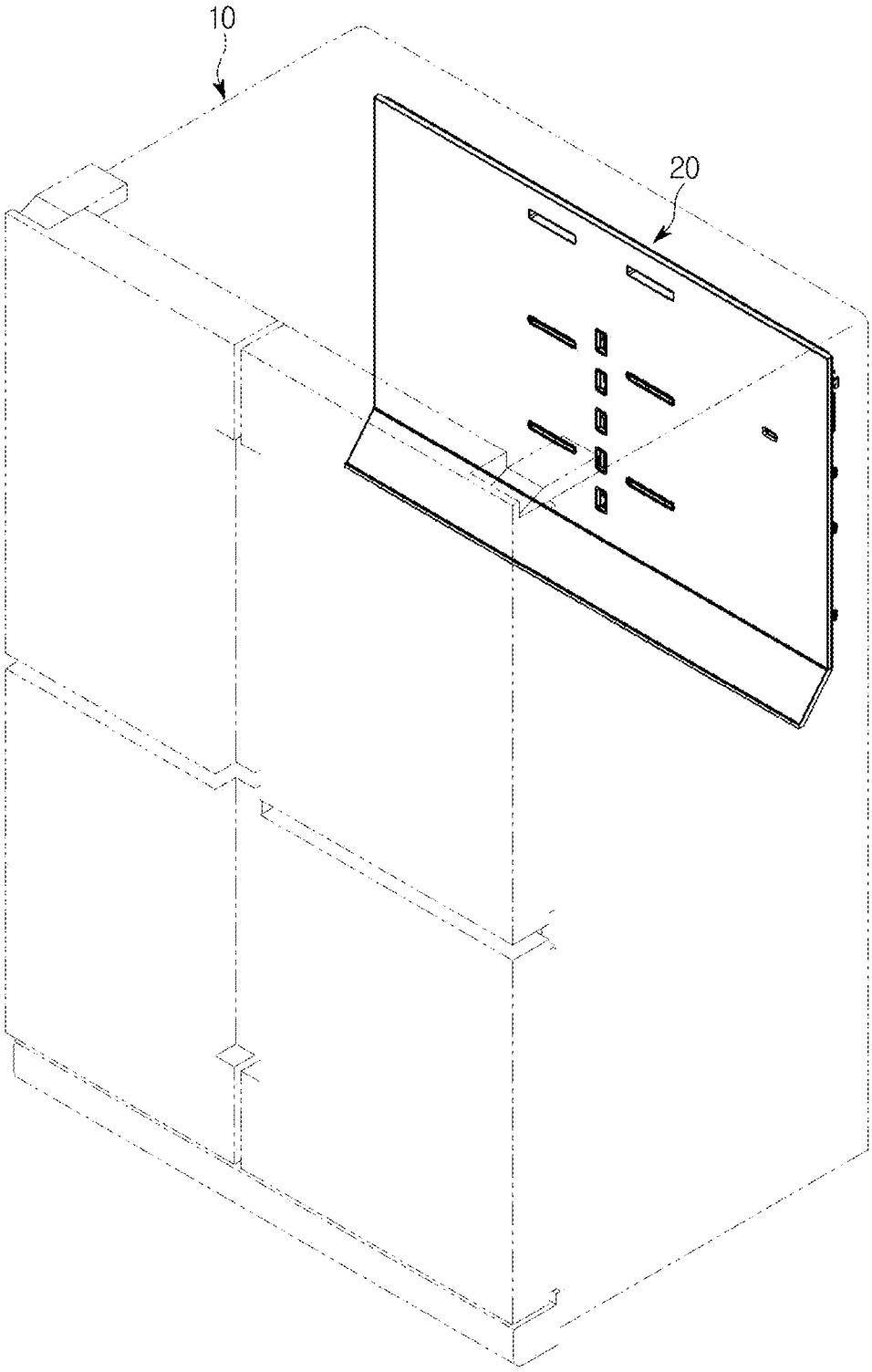
FIG. 2 is a perspective view illustrating a state in which a cold air duct is disposed in the refrigerator according to the embodiment of the present disclosure.
Figure 3:
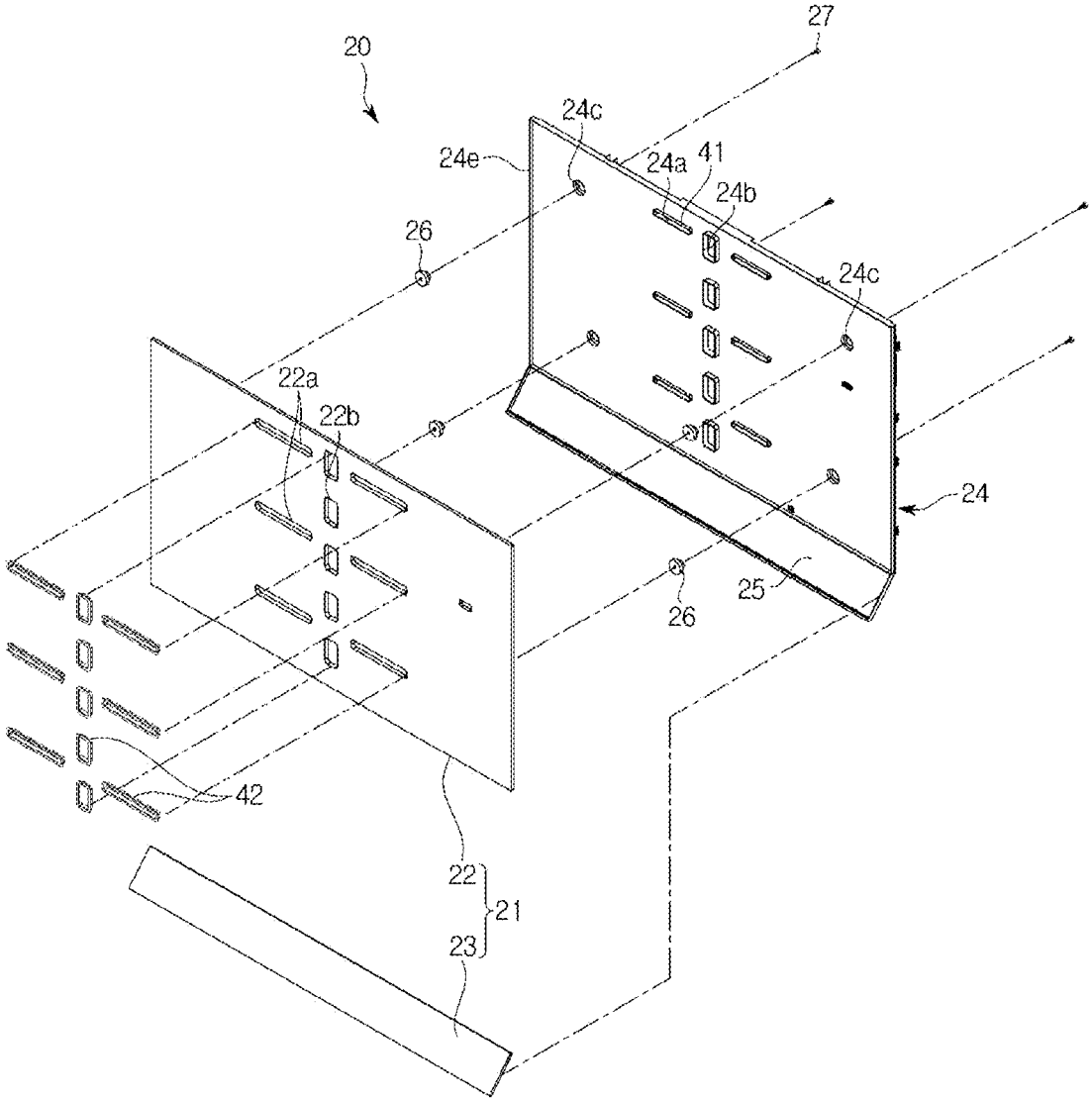
FIG. 3 is an exploded perspective view illustrating a front structure of the cold air duct according to the embodiment of the present disclosure.
Figure 4:
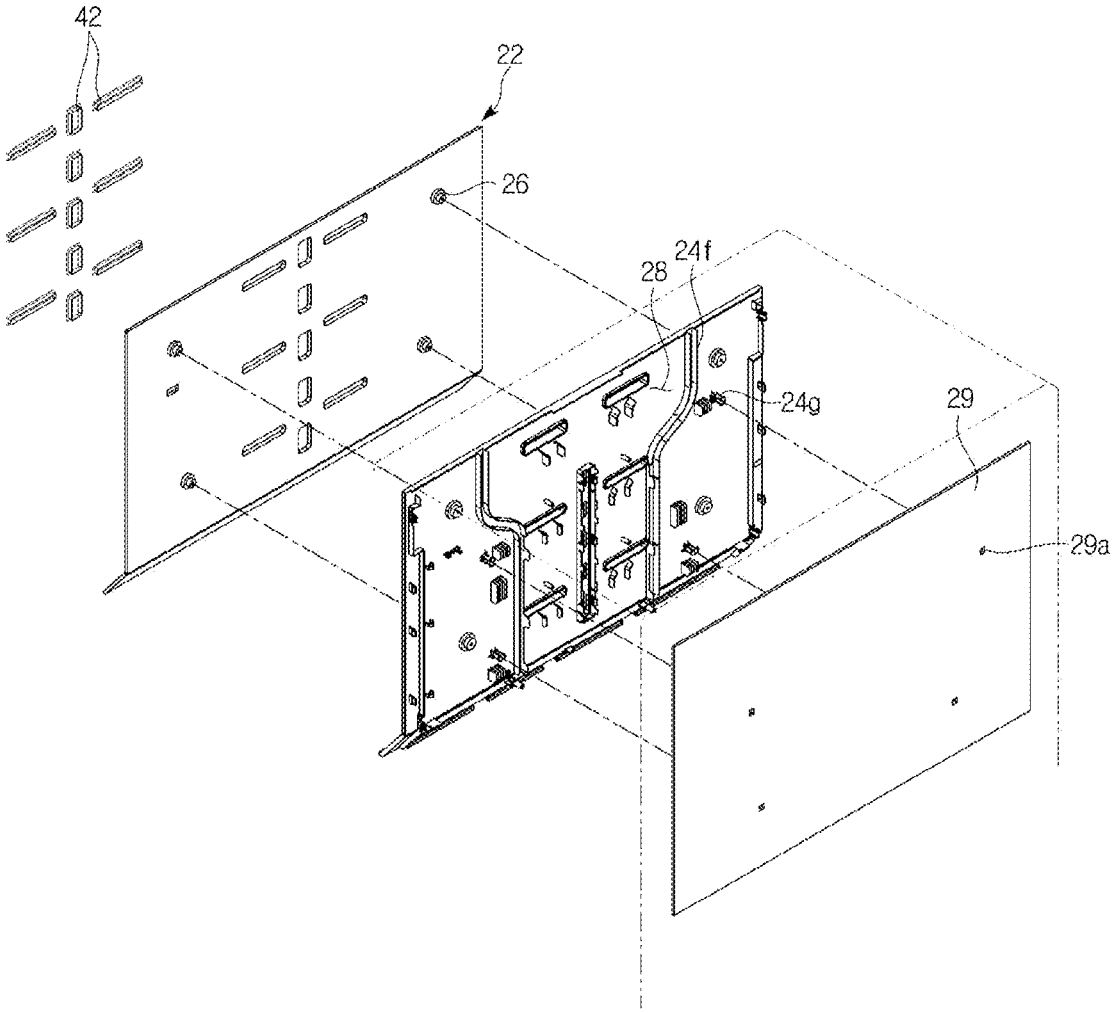
FIG. 4 is an exploded perspective view illustrating a rear structure of the cold air duct according to the embodiment of the present disclosure.

FIG. 1 is a perspective view illustrating a refrigerator according to an embodiment of the present disclosure, FIG. 2 is a perspective view illustrating a state in which a cold air duct is disposed in the refrigerator according to the embodiment of the present disclosure, FIG. 3 is an exploded perspective view illustrating a front structure of the cold air duct according to the embodiment of the present disclosure, and FIG. 4 is an exploded perspective view illustrating a rear structure of the cold air duct according to the embodiment of the present disclosure.

As illustrated in FIGS. 1 to 4, the refrigerator 1 includes a main body 10 forming storage compartments 10*a* and 10*b* configured to keep food refrigerated or frozen, and doors 11*a* and 11*b* configured to open and close the storage compartments 10*a* and 10*b* which are open.

The main body 10 may include an inner case 12 forming an inner space of the main body, an outer case 13 forming an exterior of the main body 10, and an insulating material (not illustrated) disposed between the inner case 12 and the outer case 13.

The storage compartments 10*a* and 10*b* may have an open front surface and may be divided into a refrigerator compartment 10*a* at an upper portion and a freezer compartment 10*b* at a lower portion by a partition.

The open front surface of the refrigerator compartment 10*a* may be hinge-coupled to the main body 10 and be opened and closed by a pair of refrigerator compartment doors 11*a* which are rotatable.

The open front surface of the freezer compartment 10*b* may be hinge-coupled to the main body 10 and be opened and closed by a pair of freezer compartment doors 11*b* which are rotatable.

A cold air duct 20 forming an exterior of the storage compartments 10*a* and 10*b* and configured to guide cold air to the storage compartments 10*a* and 10*b* may be installed at the storage compartments 10*a* and 10*b*.

Referring to FIG. 2, only a configuration in which the cold air duct 20 is installed at the refrigerator compartment 10*a* is illustrated. However, because the cold air duct 20 may also be installed at the freezer compartment 10*b*, a description on the freezer compartment 10*b* will be omitted.

The cold air duct 20 may include a cover plate 21 forming the exterior of the storage compartments 10*a* and 10*b*, and a cover panel 24 disposed inside the inner case 12.

The cover plate 21 may be formed of various materials to improve an appearance of the storage compartments 10*a* and 10*b*. For example, the cover plate 21 may be formed of a ceramic material, metal, wood, fiber, plastic, and a composite material thereof.

Although the ceramic material may be defined as a material formed of an oxide, a carbide, and a nitride which are formed by combining a metal element such as silicon (Si), aluminum (Al), titanium (Ti), and zirconium (Zr) with oxygen, carbon, and nitrogen, porcelain may be used as the ceramic material to improve the appearance of the storage compartments 10*a* and 10*b* as in the present embodiment.

Despite having excellent rigidity, corrosion resistance, and chemical resistance, porcelain type ceramic materials may be damaged when a large impact is thereto due to high brittleness. To compensate for the mechanical property of such ceramic materials, fiber or a metal plate may be combined with the ceramic materials, or the ceramic materials may be formed of a composite material in which fiber and a metal plate are combined.

When the cover plate 21 is formed of a ceramic material, an outer layer constituting an outer surface forming the storage compartments 10*a* and 10*b* may be formed of the ceramic material, and a reinforcing layer formed of another material capable of compensating for brittleness may be further disposed behind the outer layer.

The cover plate 21 may include a rear cover plate 22 including outlets 22*a* configured to discharge cold air to the storage compartments 10*a* and 10*b* and through-holes 22*b* provided for installation of a shelf (not illustrated) to be disposed in the storage compartments 10*a* and 10*b*, and an inclined cover plate 23 disposed below the rear cover plate 22 and forming an inclined surface.

A protective member 42 configured to protect the outlets 22*a* and the through-holes 22*b* of the rear cover plate 22 may be installed at the outlets 22*a* and the through-holes 22*b*.

The protective member 42 may be fitted into the outlets 22*a* and the through-holes 22*b* via front surfaces of the outlets 22*a* and the through-holes 22*b* to protect front side edges of the outlets 22*a* and the through-holes 22*b* and cover the front side edges of the outlets 22*a* and the through-holes 22*b*.

The cover panel 24 may include outlets 24*a* and through-holes 24*b* disposed at positions respectively corresponding to those of the outlets 22*a* and the through-holes 22*b* of the rear cover plate 22.

An inclination supporter 25 configured to support the inclined cover plate 23 may be disposed below the cover panel 24.

A rear side protective member 41 configured to cover rear side edges of the outlets 22*a* and the through-holes 22*b* of the rear cover plate 22 may be disposed in the vicinity of the outlets 24*a* and the through-holes 24*b* of the cover panel 24.

The rear side protective member 41 may extend from the vicinity of the outlets 24*a* and the through-holes 24*b* to cover the rear side edges of the outlets 22*a* and the through-holes 22*b* and protrude forward along the outlets 22*a* and the through-holes 22*b*.

The rear side protective member 41 may be configured to entirely cover an inner peripheral surface of the rear cover plate 22 in addition to both side edges of the outlets 22*a* and the through-holes 22*b* thereof with a front side protective member 42.

An edge protector 24*e* configured to cover an outer edge of the cover plate 21 may be disposed at an outer edge of the cover panel 24.

A fixing member 26 for coupling between the rear cover plate 22 and the cover panel 24 may be disposed between the rear cover plate 22 and the cover panel 24, and accommodation grooves 24*c* each configured to accommodate the fixing member 26 may be disposed in a front surface of the cover panel 24.

The fixing member 26 may be fixed to a rear surface of the rear cover plate 22 facing the cover panel 24 and may be fixed in advance to a position that may correspond to that of the accommodation groove 24*c* by an adhesive while the rear cover plate 22 and the cover panel 24 are brought close to each other before being coupled to each other.

When the rear cover plate 22 and the cover panel 24 are brought close to each other while the fixing member 26 is fixed to the rear surface of the rear cover plate 22 by an adhesive, the fixing member 26 may be accommodated in the accommodation groove 24*c*. In this state, when a fastening member 27 is coupled to the cover panel 24 and the fixing member 26, the rear cover plate 22 may be fixed to the cover panel 24.

A guide rib 24*f* configured to guide cold air to each of the outlets 24*a* and a locking hook 24*g* configured to fix the cover panel 24 to the storage compartments 10*a* and 10*b* while the cover plate 21 is fixed to the cover panel 24 may be disposed at a rear surface of the cover panel 24.

The guide rib 24*f* forms a cold air flow path 28 configured to guide cold air generated in an evaporator (not illustrated) to be distributed to each of the outlets 24*a*.

The locking hook 24*g* may be coupled to a locking groove 29*a* disposed in an evaporator cover 29 disposed between the cover panel 24 and the evaporator (not illustrated).

Although the cover panel 24 is illustrated as an element constituting the cold air duct 20 configured to distribute cold air with the evaporator cover 29 in the drawings, the idea of the present disclosure is not limited thereto. For example, the cover panel 24 may be a structure such as an evaporator cover directly fixed to the inner case 12 or may be a simple cover that does not form a cold air duct.

Figure 5:
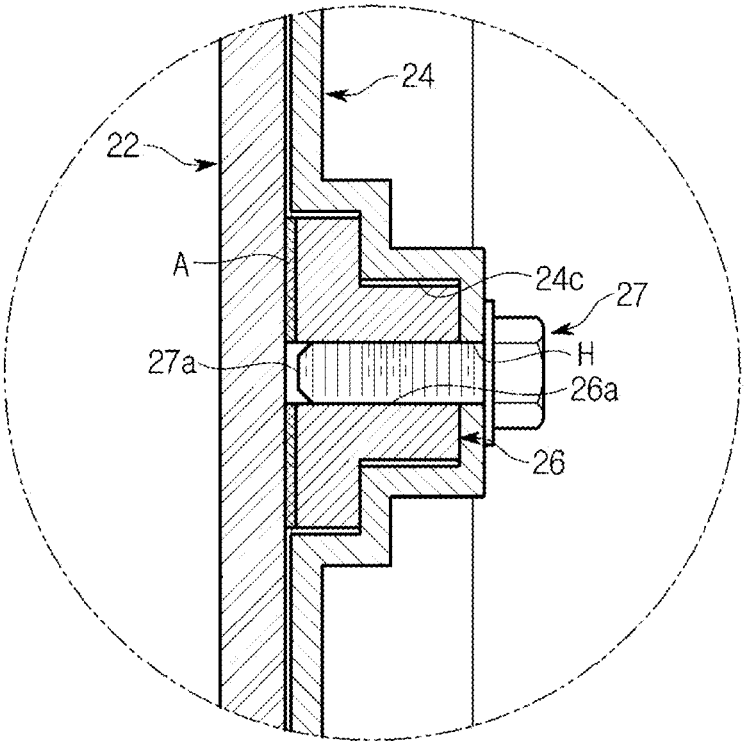
FIG. 5 is a cross-sectional view illustrating an arrangement relation of a fixing member while a cover plate and a cover panel are coupled to each other according to the embodiment of the present disclosure.

FIG. 5 is a cross-sectional view illustrating an arrangement relation of a fixing member while a cover plate and a cover panel are coupled to each other according to the embodiment of the present disclosure.

The fixing member 26 may be disposed between the rear surface of the rear cover plate 22 and the front surface of the cover panel 24. Although integrally forming a structure such as the fixing member 26 with the rear cover plate 22 may be taken into consideration when the cover plate 21 is manufactured using a material that may be easily injection-molded such as a plastic material, when the rear cover plate 22 is formed of a ceramic material or a composite material including the same as in the embodiment of the present disclosure, manufacturing the fixing member 26 as a separate component from the rear cover plate 22 and then fixing the fixing member 26 to the rear cover plate 22 may be advantageous for a manufacturing process and in securing a mechanical strength.

A fastening hole 26*a* to which the fastening member 27 may be coupled may be disposed in the fixing member 26. An adhesive A may be applied between the front surface of the fixing member 26 and the rear surface of the rear cover plate 22, and the fixing member 26 may be attached to the rear surface of the cover plate 21 by an adhesive force of the adhesive.

A hot melt type adhesive may be used as the adhesive A. In this case, a heated and melted adhesive may be applied between the front surface of the fixing member 26 and the rear surface of the rear cover plate 22 and then hardened by cooling, thereby fixing the fixing member 26 to the rear surface of the rear cover plate 22.

The fixing member 26 may be formed to have a circular cross-section, and the front surface of the fixing member 26 may be formed to have a proper area for a contact surface to be secured between the fixing member 26 and the rear cover plate 22.

The accommodation groove 24*c* may be formed to have a depth capable of completely accommodating the fixing member 26 as illustrated or may be formed to have a depth capable of partially accommodating the fixing member 26 so that a distance between the rear cover plate 22 and the cover panel 24 is not too large.

The fastening member 27 may be formed to have a length such that an end 27*a* of the fastening member 27 does not come in contact with the rear surface of the rear cover plate 22 while the fastening member 27 is completely inserted into a fastening hole H of the cover panel 24 and the fastening hole 26*a* of the fixing member 26.

Although the fastening member 27 is illustrated as a fastening screw in the illustrated example, this is merely an example, and the idea of the present disclosure is not limited thereto. For example, the fastening member may be formed to have a hook structure.

Figure 6:
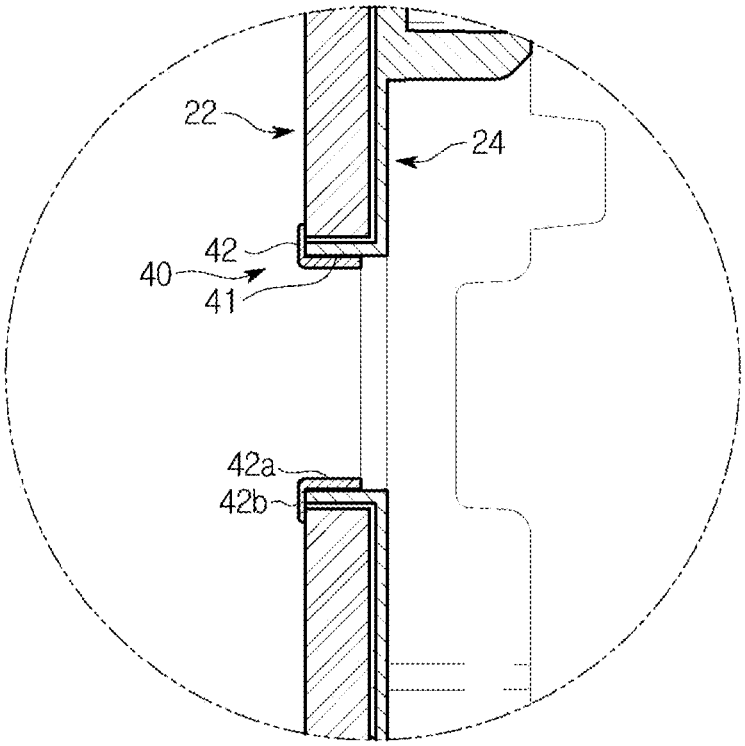
FIG. 6 is a cross-sectional view illustrating an arrangement relation of a protector while the cover plate and the cover panel are coupled to each other according to the embodiment of the present disclosure.

FIG. 6 is a cross-sectional view illustrating an arrangement relation of a protector while the cover plate and the cover panel are coupled to each other according to the embodiment of the present disclosure.

Referring to FIG. 6, a protector 40 may be installed at each of the outlets 22*a* of the rear cover plate 22 to protect the each of the outlets 22*a*.

The protector 40 may include the rear side protective member 41 configured to cover a rear side edge R of the outlet 22*a* and extending forward along an inner surface of the outlet 22*a*, and the front side protective member 42 configured to cover a front side edge F of the outlet 22*a*.

The rear side protective member 41 may extend forward from the vicinity of the outlet 24*a* of the cover panel 24 and be integrally configured with the cover panel 24. The rear side protective member 41 may cover the rear side edge R of the outlet 22*a*, extend forward along the inner surface of the outlet 22*a*, and have a front end disposed on the same plane as the front surface of the rear cover plate 22 without protruding further than the front side edge F of the outlet 22*a* or disposed inside the outlet 22*a*.

The front side protective member 42 may include a fixer 42*a* disposed inside the outlet 22*a* and a cover 42*b* configured to cover the front side edge F of the outlet 22*a*.

The fixer 42*a* may be assembled to an inner peripheral surface of the rear side protective member 41 by being forcibly fitted thereto or be coupled to the rear side protective member 41 by hook coupling.

The cover 42*b* may be formed to extend along the front surface of the rear cover plate 22 to cover and protect the front side edge F and cover a clearance formed between the rear side protective member 41 and the outlet 22*a* to prevent the clearance from being exposed to outside.

Referring to the drawings, only an example in which the protector 40 is applied to the outlet 22*a* is illustrated. However, because the protector 40 having the same structure may also be applied to the through-hole 22*b*, description of the protector installed in the through-hole 22*b* will be omitted.

Rather than being fitted to the outlet 22*a* to completely come in contact with the outlet 22*a*, the rear side protective member 41 is preferably disposed such that the rear side protective member 41 is spaced apart from the outlet 22*a* by a small distance or at least inner surfaces of the rear side protective member 41 and the outlet 22*a* come in point contact partially instead of coming in surface contact completely. This is because, when the cover plate 21 is formed of a hard material such as a ceramic material, stress may be focused on the outlet 22*a* when the inner surfaces of the rear side protective member 41 and the outlet 22*a* come in surface contact completely, and an edge portion of the outlet 22*a* may be damaged due to the stress.

Figure 7:
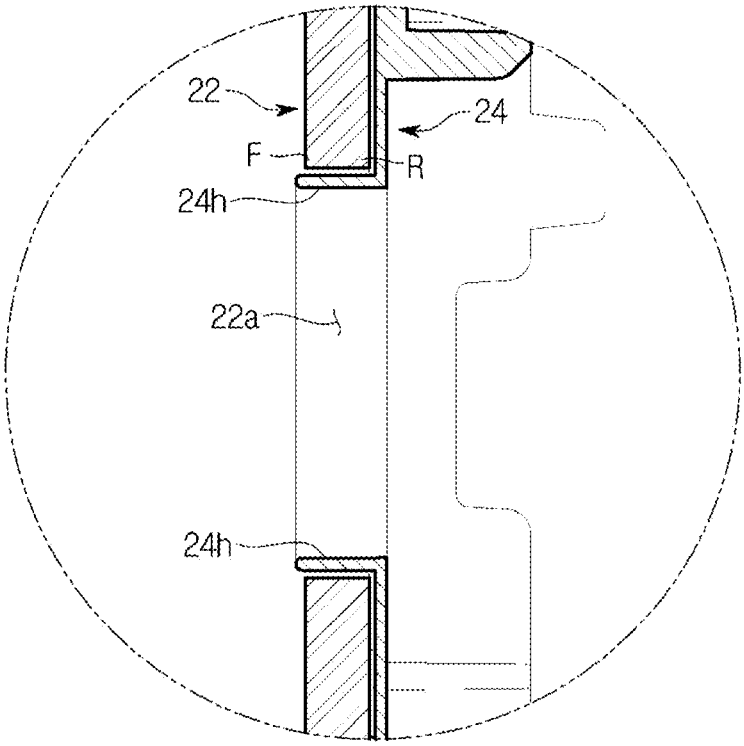
FIG. 7 is a cross-sectional view illustrating an arrangement relation of a protector while a cover plate and a cover panel are coupled to each other according to another embodiment of the present disclosure.

FIG. 7 is a cross-sectional view illustrating an arrangement relation of a protector while a cover plate and a cover panel are coupled to each other according to another embodiment of the present disclosure.

The protector may include a protective member 24*h* configured not to completely cover the front side edge F of the outlet 22*a* and protruding forward along the inner surface of the outlet 22*a*.

The protective member 24*h* may extend forward from the vicinity of the outlet 24*a* of the cover panel 24 and be integrally configured with the cover panel 24. The protective member 24*h* may cover the rear side edge R of the outlet 22*a*, extend forward along the inner surface of the outlet 22*a*, and have an end protruding further forward than the front side edge F of the outlet 22*a*.

Because a front end of the protective member 24*h* protrudes further forward than the front side edge F of the outlet 22*a*, the front side edge F of the outlet 22*a* may be protected so that a direct impact is not applied thereto.

Rather than being fitted to the outlet 22*a* to completely come in contact with the outlet 22*a*, the protective member 24*h* is preferably disposed such that the protective member 24*h* is spaced apart from the outlet 22*a* by a small distance or at least inner surfaces of the protective member 24*h* and the outlet 22*a* come in point contact partially instead of coming in surface contact completely. This is because, when the cover plate 21 is formed of a hard material such as a ceramic material, stress may be focused on the outlet 22*a* when the inner surfaces of the protective member 24*h* and the outlet 22*a* come in surface contact completely, and an edge portion of the outlet 22*a* may be damaged due to the stress.

Figure 8:
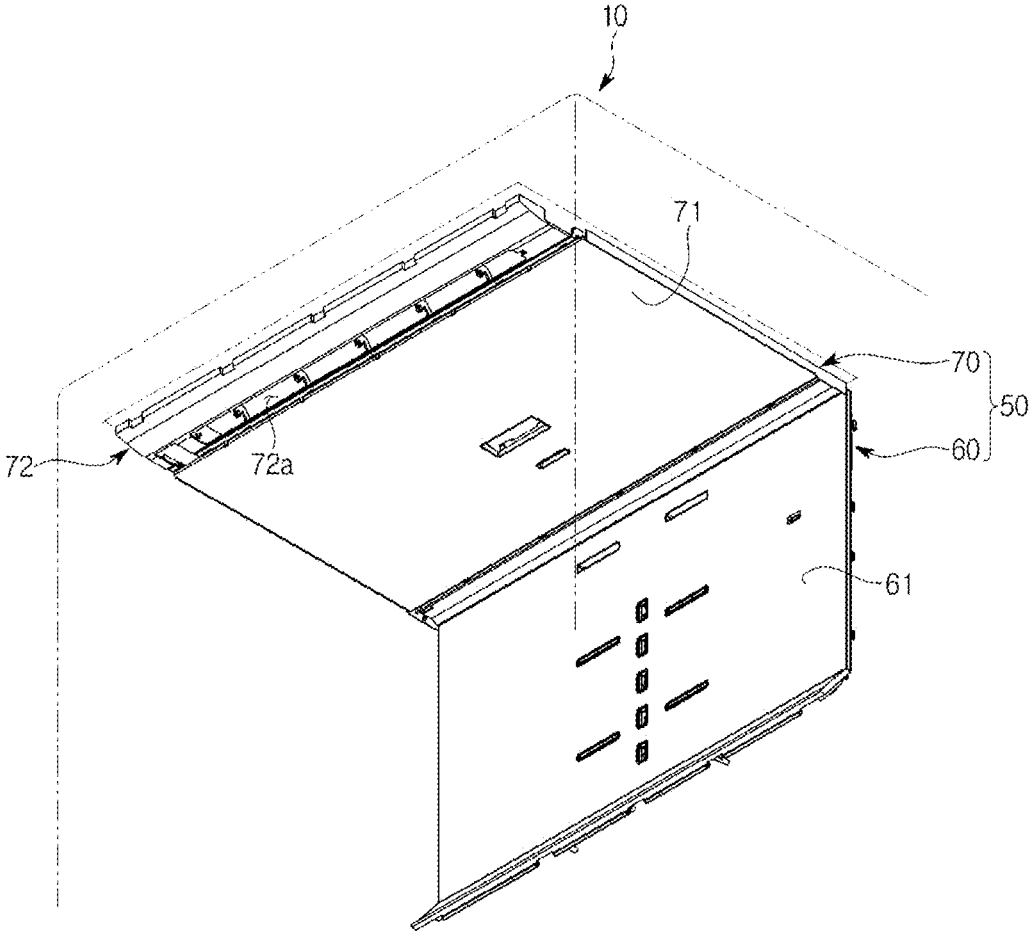
FIG. 8 is a perspective view illustrating a state in which a cold air duct is disposed in a storage compartment according to still another embodiment of the present disclosure.
Figure 9:
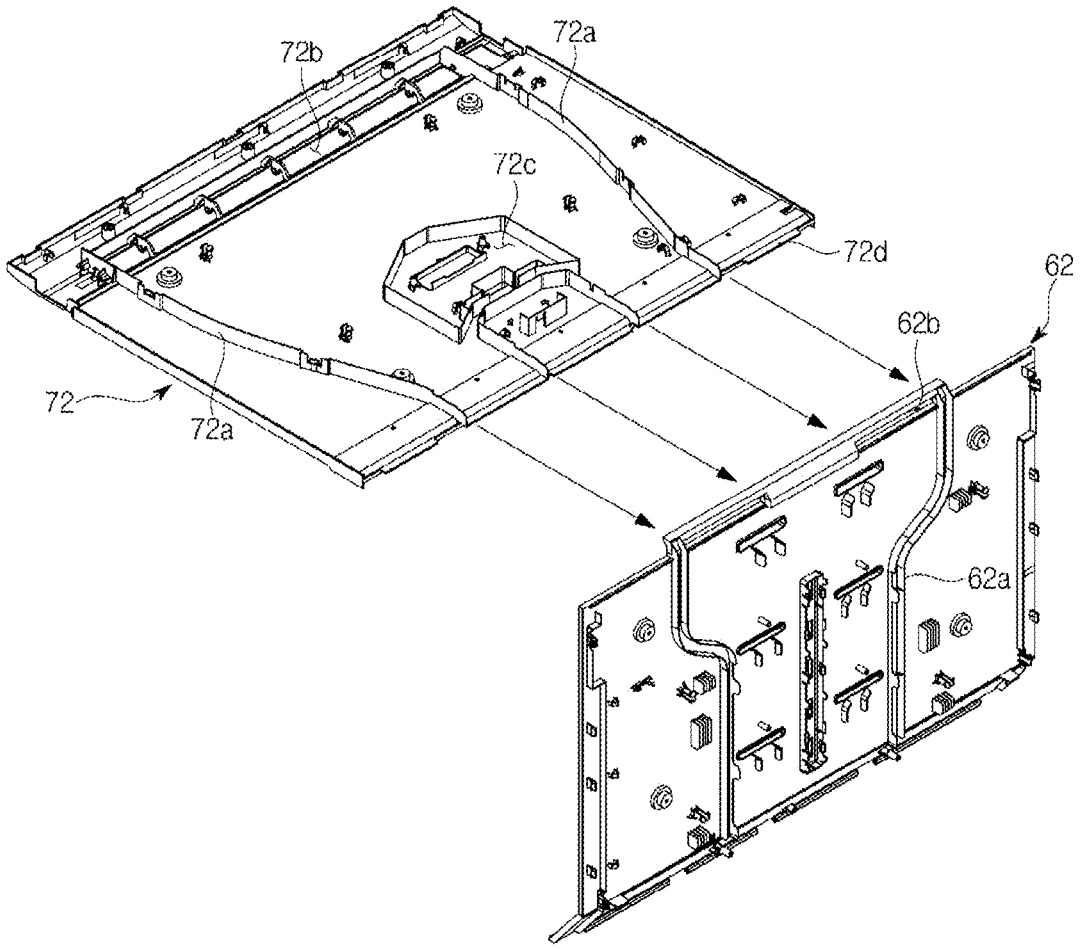
FIG. 9 is an exploded perspective view of the cold air duct according to the other embodiment of the present disclosure.
Figure 10:
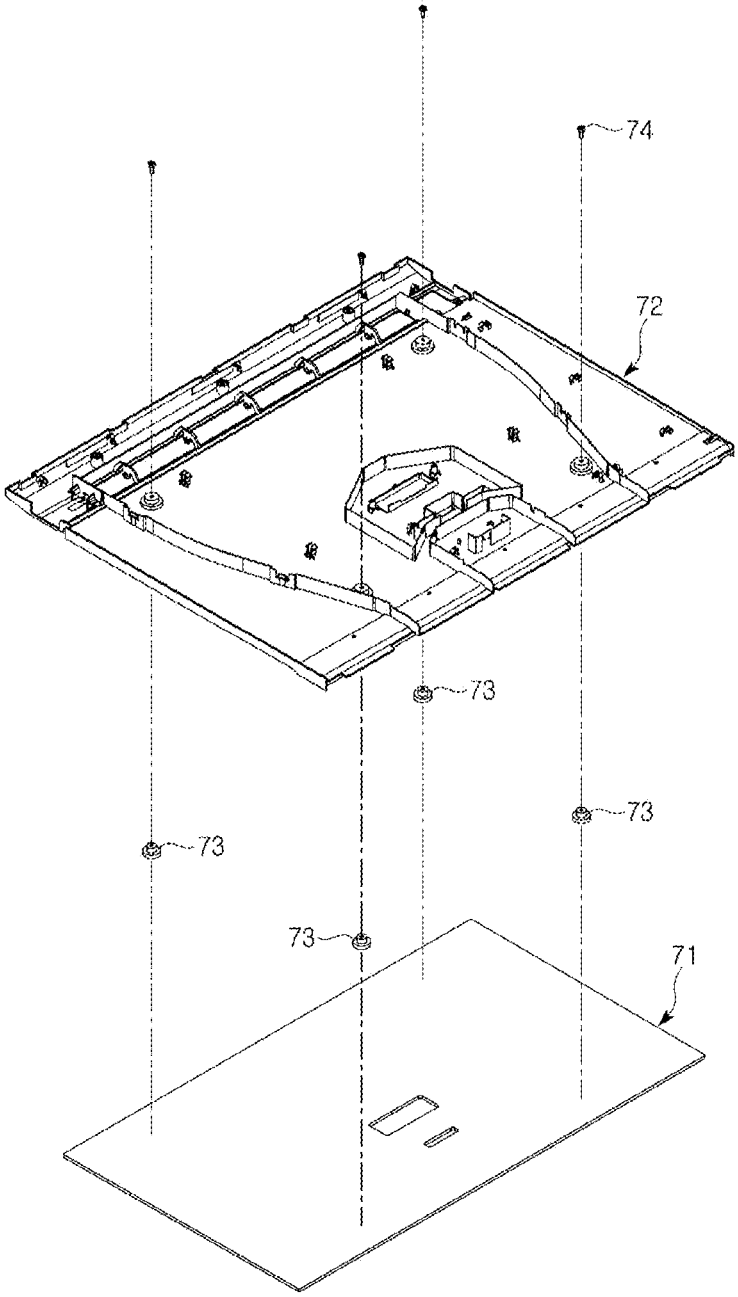
FIG. 10 is an exploded perspective view of an upper cold air duct according to the other embodiment of the present disclosure.

FIG. 8 is a perspective view illustrating a state in which a cold air duct is disposed in a storage compartment according to still another embodiment of the present disclosure, FIG. 9 is an exploded perspective view of the cold air duct according to the other embodiment of the present disclosure, and FIG. 10 is an exploded perspective view of an upper cold air duct according to the other embodiment of the present disclosure.

A cold air duct 50 according to the present embodiment may include a rear side cold air duct 60 and an upper cold air duct 70 respectively disposed at a rear surface and an upper surface of the storage compartment 10*a*.

Because the rear side cold air duct 60 may be substantially identically configured as the cold air duct according to the embodiments illustrated in FIGS. 1 to 7, description on overlapping content will be omitted, and differences from the cold air duct according to the above-described embodiments will be mainly described.

A rear side cover plate 61 forming an exterior of the storage compartment 10*a* may be disposed at a front surface of the rear side cold air duct 60, and a rear surface of the rear side cold air duct 60 may be configured with a rear side cover panel 62 configured to guide cold air.

A guide rib 62*a* configured to guide cold air may be disposed at a rear surface of the rear side cover panel 62, and a connector 62*b* configured to supply cold air to an upper cover panel 72, which will be described below, may be disposed above the rear side cover panel 62.

Because coupling relations between the rear side cover plate 61 and the rear side cover panel 62 other than those described above are the same as the above-described embodiments, descriptions thereof will be omitted.

The upper cold air duct 70 may also include an upper cover plate 71 forming the exterior of the storage compartment 10*a* and the upper cover panel 72 configured to guide cold air.

Like the rear side cover plate 61, the upper cover plate 71 may also be formed of various materials including a ceramic material and capable of improving an appearance of the storage compartment 10*a*. However, the upper cover plate 71 is may be different from the rear side cover plate 61 in that an outlet is not formed in the upper cover plate 71, and an outlet 72*b* configured to discharge cold air is disposed in the upper cover panel 72.

The upper cover panel 72 may include a guide rib 72*a* configured to guide cold air supplied from the rear side cover panel 62 to the outlet 72*b*, an accommodation space 72*c* configured to accommodate a lighting device (not illustrated), and a support protrusion 72*d* coupled to an upper end of the rear side cover panel 62 for the upper cover panel 72 to be supported by the rear side cover panel 62.

Coupling between the upper cover plate 71 and the upper cover panel 72 may be performed by a fixing member 73 and a fastening member 74 as in the configuration of the rear side cold air duct 60. Because this has been described above, a detailed description thereof will be omitted.

Figure 11:
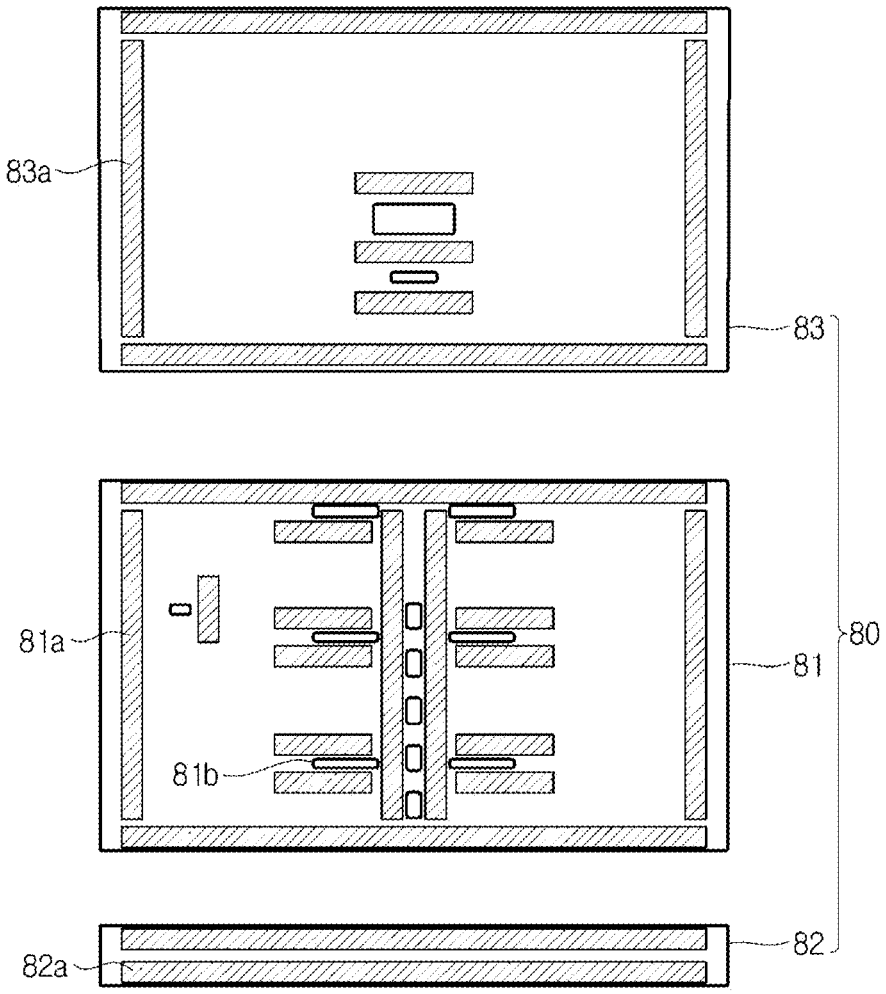
FIG. 11 is a view illustrating a fixing structure of a cover plate according to yet another embodiment of the present disclosure.
Figure 12:
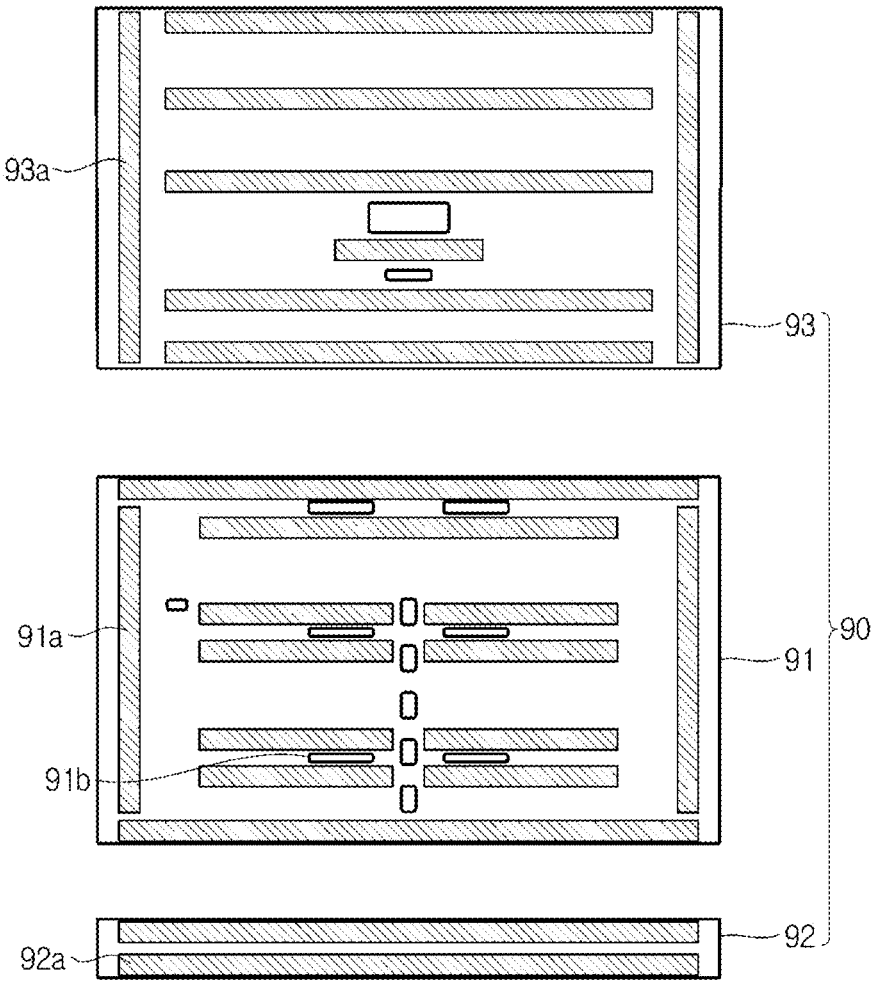
FIG. 12 is a view illustrating a fixing structure of a cover plate according to yet another embodiment of the present disclosure.

FIG. 11 is a view illustrating a fixing structure of a cover plate 80 according to yet another embodiment of the present disclosure, and FIG. 12 is a view illustrating a fixing structure of a cover plate 90 according to yet another embodiment of the present disclosure.

Referring to FIG. 11, a cover plate 80 includes a rear side cover plate 81 forming a rear surface of the storage compartment, an inclined cover plate 82 disposed below the rear side cover plate 81, and an upper cover plate 83 forming an upper surface of the storage compartment, and such a configuration is the same as the embodiment according to FIGS. 8 to 10.

A difference from the previous embodiment is that adhesives 81*a*, 82*a*, and 83*a* are used in a method of coupling the cover plate 80 to a cover panel.

The adhesives 81*a*, 82*a*, and 83*a* may be a hot melt type adhesive, and the cover plates 81, 82, and 83 may be attached to the cover panel while the adhesives 81*a*, 82*a*, and 83*a* are respectively applied to surfaces of the cover plates 81, 82, and 83.

Referring to FIG. 11, an example of a pattern that may be taken into consideration when the adhesives 81*a*, 82*a*, and 83*a* are respectively applied to the cover plates 81, 82, and 83 is illustrated.

The adhesives 81*a*, 82*a*, and 83*a* may be applied such that the adhesives 81*a*, 82*a*, and 83*a* are more densely distributed at the edges of the cover plates 81, 82, and 83 than inner areas thereof.

A hot melt type adhesive exhibits a strong coupling force between two members when the hot melt type adhesive is cooled and hardened. When a large temperature change occurs as in an environment of the storage compartment while two members having different thermal expansion coefficients, such as the cover plates 81, 82, and 83 and the cover panel, are coupled, high stress may be generated between the two members due to the difference in the thermal expansion coefficients. Here, the cover plates 81, 82, and 83 having relatively high brittleness may be damaged, or adhered portions between the cover plates 81, 82, and 83 and the cover plate may be separated. Consequently, instead of applying an adhesive throughout adhering surfaces of the cover plates 81, 82, and 83, the adhesives 81*a*, 82*a*, and 83*a* may be mostly applied to the edges of the cover plates 81, 82, and 83 and portions thereof in the vicinity of an outlet 72*b* so that stress may be mitigated at areas on which the adhesives 81*a*, 82*a*, and 83*a* are not applied.

According to FIG. 12, an example of a pattern that may be taken into consideration when double-sided tapes 91*a*, 92*a*, and 93*a* are respectively attached to cover plates 91, 92, and 93 is illustrated.

A foam type double-sided tape may be used as the double-sided tapes 91*a*, 92*a*, and 93*a*.

Although the foam type double-sided tape may have a smaller coupling force than the above-described hot melt type adhesive, the foam type double-sided tape may absorb a deformation due to a difference in thermal expansion coefficients and mitigate stress by a foam structure.

The double-sided tapes 91*a*, 92*a*, and 93*a* may be attached such that the double-sided tapes 91*a*, 92*a*, and 93*a* are mostly attached to edges of the cover plates 91, 92, and 93 and portions thereof in the vicinity of an outlet 72*b*. Here, the double-sided tapes 91*a*, 92*a*, and 93*a* may be attached to a larger number of areas in comparison to the above-described case in which the adhesives are used.

As is apparent from the above description, according to an embodiment of the present disclosure, a configuration of an inner wall forming a storage compartment can be improved, and an appearance of the storage compartment can be improved.

Further, a possibility of damage due to an impact that may be generated in an actual use environment and during transport can be lowered.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body having a storage compartment;

an inner case forming an inner space of the main body;

a cover plate installed as an exterior of the inner case to form a surface of the storage compartment and formed of a ceramic material;

a cover panel disposed inside the inner case and configured to guide cold air to be supplied to the storage compartment;

a fixing member fixed to a rear surface of the cover plate by an adhesive applied between a front surface of the fixing member and the rear surface of the cover plate; and a fastening member configured to connect to the fixing member through the cover panel while the fixing member is fixed to the cover plate to couple the cover panel to the cover plate.

2. The refrigerator of claim 1, wherein the cover panel includes an accommodation groove configured to accommodate the fixing member.

3. The refrigerator of claim 1, wherein the cover plate includes an outlet configured to discharge cold air to the storage compartment and further includes a protector disposed at the outlet to protect an edge of the outlet.

4. The refrigerator of claim 3, wherein the protector includes a front side protective member formed to cover a front side edge of the outlet while being coupled to the outlet.

5. The refrigerator of claim 3, wherein the protector includes a protective member passing through the outlet while the cover plate and the cover panel are coupled and extending forward from the cover panel to protrude further forward than the edge of the outlet.

6. A refrigerator comprising:

a main body having a storage compartment therein;

a cover panel having a cold air duct, which is configured to guide cold air to the storage compartment, formed at one side surface;

a cover plate coupled to an other side surface of the cover panel, forming an exterior of the storage compartment, and formed of a ceramic material;

a fixing member fixed to a rear surface of the cover plate; and a fastening member configured to connect between the cover panel and the fixing member while the fixing member is fixed to the cover plate to couple the cover panel to the cover plate, wherein the fixing member is fixed to the cover plate by an adhesive applied between a front surface of the fixing member and the rear surface of the cover plate.

7. The refrigerator of claim 6, wherein:

the cover panel includes a rear cover panel forming a rear wall of the storage compartment and an upper cover panel forming an upper wall of the storage compartment; and the cover plate includes a rear cover plate coupled to the rear cover panel and an upper cover plate coupled to the upper cover panel.

8. The refrigerator of claim 7, wherein the rear cover panel and the rear cover plate include an outlet configured to discharge the cold air to the storage compartment and further include a front side protective member installed at the outlet to cover a front side edge of the outlet.

9. The refrigerator of claim 8, wherein the rear cover panel includes a rear side protective member configured to cover a rear side edge of the outlet.

10. The refrigerator of claim 7, wherein:

the rear cover panel and the rear cover plate include an outlet configured to discharge the cold air to the storage compartment; and the rear cover panel includes a protective member configured to cover a rear side edge of the outlet and extending to protrude further than a front side edge of the outlet.

11. A refrigerator comprising:

an inner case forming an inner space;

a cover panel configured to cover at least one surface of the inner case;

a cover plate configured to cover one side surface of the cover panel and including an outer layer formed of a ceramic material;

at least one fixing member disposed at one side surface of the cover plate opposite the cover panel to allow coupling between the cover panel and the cover plate; and at least one fastening member configured to connect between the cover panel and the at least one fixing member while the at least one fixing member is fixed to the cover plate to couple the cover panel to the cover plate, wherein each of the at least one fixing member is fixed to the cover plate by an adhesive applied between a front surface of the at least one fixing member and a rear surface of the cover plate.

12. The refrigerator of claim 11, wherein the cover panel includes an accommodation groove, which is configured to accommodate the at least one fixing member, disposed at one side surface.

* * * * *